US006481515B1

(12) United States Patent
Kirkpatrick et al.

(10) Patent No.: US 6,481,515 B1
(45) Date of Patent: Nov. 19, 2002

(54) AUTONOMOUS MOBILE SURFACE TREATING APPARATUS

(75) Inventors: James F. Kirkpatrick, Milford; Harry B. Maddox, Cincinnati; Kevin B. Clendenien, Cincinnati; Andrew Weatherston, Cincinnati; Charles W. Fisher, Loveland; Gary G. Heaton, Cincinnati; Larry R. Genskow, West Chester; Christopher J. Binski, Cincinnati, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 45 days.

(21) Appl. No.: 09/580,083

(22) Filed: May 30, 2000

(51) Int. Cl.[7] ..... B60K 1/00
(52) U.S. Cl. ..... 180/65.1; 15/319
(58) Field of Search ..... 180/295, 167, 180/168, 169, 65.1, 65.8, 908, 204, 65.5, 212, 89.12, 275, 276, 277, 278, 279; 15/319, 340.1, 340.3, 340.4, 320; 318/568.11, 568.12; 280/124.177; 701/23; 901/1

(56) References Cited

U.S. PATENT DOCUMENTS

| | | | |
|---|---|---|---|
| 367,420 | A | 8/1887 | Luchs |
| 2,770,074 | A | 11/1956 | Jones |

(List continued on next page.)

FOREIGN PATENT DOCUMENTS

| | | |
|---|---|---|
| DE | 3536974 | 4/1987 |
| EP | 0786229 | 7/1997 |
| FR | 2324047 | 4/1977 |
| JP | 99178764 | 7/1999 |
| JP | 99178765 | 7/1999 |
| WO | 90/14788 | * 12/1990 |
| WO | WO 9702075 | 1/1997 |

OTHER PUBLICATIONS

M. Sekiguchi et al., "Behavior Control For A Mobile Robot By Multi–Hierarchical Neural Network", Proceedings of the International Conference on Robotics and Automation, Scottsdale, May 15–19, 1989, vol. 3, May 15, 1989, pp. 1578–1583, XP000044339, Institute of Electrical and Electronics Engineers.

(List continued on next page.)

*Primary Examiner*—Brian L. Johnson
*Assistant Examiner*—Bryan Fischmann
(74) *Attorney, Agent, or Firm*—Peter D. Meyer

(57) ABSTRACT

One aspect of the invention is directed to an autonomous mobile surface treating apparatus having a chassis, a drive mechanism mounted to the said chassis by a suspension, and a substantially rigid shell movably mounted to the chassis. The suspension includes a resilient member interposed between the drive mechanism and the chassis so that when the shell is pushed toward the supporting surface with a predetermined force the resilient member compresses to permit the drive mechanism to move and the shell and/or the chassis to contact the supporting surface. A second aspect of the invention is directed to the movable support of shell relative to the chassis. The shell is supported by a plurality of elongated elastic supports received within plurality of elongated openings in the chassis. Preferably, a passive portion of a collision detection sensor is attached to a central portion of the shell. A third aspect of the invention is directed to a non-skid lower edge member movably attached to the shell to adjust a clearance between the non-skid lower edge member and the supporting surface. A fourth aspect of the invention is directed to a vacant volume that defines a module receiving area adapted to removeably receive a surface treatment module, preferably a plurality of types of surface treatment modules including a pressure adjusting module. A fifth aspect of the invention is directed to a surface treatment module adapted to be removably received in a surface treatment module receiving area of an autonomous mobile surface treating apparatus.

32 Claims, 9 Drawing Sheets

U.S. PATENT DOCUMENTS 3,088,157 A 5/1963 Aguilar
3,952,361 A 4/1976 Wilkins
3,963,096 A * 6/1976 Jones
4,114,711 A 9/1978 Wilkins
4,161,793 A * 7/1979 Merchan
4,306,329 A * 12/1981 Yokoi ..... 15/319
4,515,235 A * 5/1985 Yamomoto et al. ..... 180/168
4,674,048 A 6/1987 Okumura
4,700,427 A 10/1987 Knepper
4,702,718 A 10/1987 Yanase
4,782,550 A * 11/1988 Jacobs ..... 15/319 X
4,933,864 A 6/1990 Evans, Jr. et al.
4,977,639 A * 12/1990 Takahashi et al. ..... 15/319
5,012,886 A * 5/1991 Jonas et al. ..... 180/279
5,109,566 A * 5/1992 Kobayaski et al. ..... 15/319
5,155,684 A 10/1992 Burke et al.
5,279,672 A * 1/1994 Betker et al. ..... 15/319 X
5,293,955 A * 3/1994 Lee ..... 180/169
5,341,540 A * 8/1994 Soupert et al. ..... 15/319
5,440,216 A * 8/1995 Kim ..... 318/568.12
5,451,014 A 9/1995 Dare et al.
5,613,261 A 3/1997 Kawakami et al.
5,622,236 A 4/1997 Azumi et al.
5,636,402 A * 6/1997 Kubo et al. ..... 15/319 X
5,787,545 A * 8/1998 Colens ..... 15/319
5,815,880 A 10/1998 Nakanishi
5,883,861 A 3/1999 Moser et al.
5,894,621 A * 4/1999 Kubo ..... 15/319 X
5,903,124 A * 5/1999 Kawakami ..... 318/568.11 X
5,904,196 A 5/1999 Wickers
5,917,442 A 6/1999 Manoogian
5,919,078 A 7/1999 Cassidy
5,940,927 A * 8/1999 Haegermarck et al. ..... 15/319
5,942,869 A 8/1999 Katou et al.
5,943,009 A 8/1999 Abbott
5,974,347 A 10/1999 Nelson
5,988,306 A * 11/1999 Ooishi ..... 180/168
5,999,866 A 12/1999 Kelly et al.
6,076,025 A 6/2000 Ueno et al.
6,076,226 A * 6/2000 Reed ..... 15/319
6,119,057 A * 9/2000 Kawagoe ..... 701/23

OTHER PUBLICATIONS

A. Holenstein et al., "Collision Avoidance In A Behavior–Based Mobile Robot Design", Proceedings of the International Conference on Robotics and Automation, Sacramento, Apr. 9–11, 1991, vol. 1, No. Conf. 7, Apr. 9, 1991, pp. 898–903, XP000218429, Institute of Electrical and Electronics Engineers.

Fei Yue Wang et al., "A Petri–Net Coordination Model For An Intelligent Mobile Robot", IEEE Transactions On Systems, Man And Cybernetics, vol. 21, No. 4, Jul. 1, 1991, pp. 777–789, XP000263601.

R. Hinkel et al., "An Application For A Distributed Computer Architecture–Realtime Data Processing In An Autonomous Mobile Robot", International Conference On Distributed Computing Systems, San Jose, Jun. 13–17, 1988, pp. 410–417m XP000040240, Institute of Electrical And Electronics Engineers.

Radio Shack Product Catologue No. Dustbot 600–2556. A CD–Rom is enclosed containing pictures and movies of the Radio Shack Dustbot.

U.S. application No. 09/715,307, Bartsch et al., filed Nov. 17, 2000.

U.S. application No. 09/743,933, Bottomley et al., filed Jul. 16, 1999.

* cited by examiner

AUTONOMOUS MOBILE SURFACE TREATING APPARATUS

BACKGROUND OF THE INVENTION

1. Field of the Invention

The invention relates to autonomous mobile devices and more particularly to self-powered and self-guided surface treating apparatus for treating a surface, such as a floor.

2. Description of the Related Art

Despite a large potential market, autonomous mobile surface treating devices have not been commercially successful to date. Over the years, developers have repeatedly attempted to automate cleaning appliances with highly kinetic cleaning parts such as floor scrubbers and vacuum cleaners. For example, U.S. Pat. No. 5,815,880, issued Oct. 6, 1998 to Nakanishi, discloses a microprocessor controlled cleaning robot wherein rotating scrub pads dispense a cleaning solution. U.S. Pat. No. 5,940,927, issued Aug. 24, 1999 to Haegermarck et al., discloses a microprocessor-controlled autonomous surface cleaning apparatus wherein a rotating brush roller is reversed after it is entangled or blocked. Such autonomous cleaning appliances with highly kinetic cleaning parts are inherently complex and expensive. In addition, a substantial amount of energy is required to move the highly kinetic cleaning parts. Thus, such autonomous cleaning appliances require a large battery capacity to provide even a short duration of use. Moreover, being highly kinetic, these parts may present a safety concern when used around children or pets.

Autonomous mobile cleaning devices with passive cleaning parts are also known. For example, Japanese Unexamined Patent Publication Hei 11-178764 (Japanese Patent Application Hei 9-394774) published Jul. 6, 1999 and Japanese Unexamined Patent Publication Hei 11-178765 (Japanese Patent Application Hei 9-364773) published Jul. 6, 1999, hereinafter referred to as the Ichiro applications, each disclose a "small and simple cleaning robot" having a deformable, dome-shaped cover provided with contact switches that are activated by the deflection of the cover when the robot runs into obstacles. Four separate contact switches, i.e., front, left side, rear and right side, are mounted on the lower portion of the robot frame adjacent the cover. The reliability of the switches depends on the amount of deflection of the cover and the location of the deflection of the cover relative to the switches. For example, if deflection of the cover occurs between two of the switches, the deflection may not be enough to activate the switches. Increasing the number of switches would reduce this problem, but at greater expense and complexity. The robot has independent left and right drive wheels, independently controlled by a microprocessor, that allow the robot to rotate when a collision is sensed by contact switches actuated by deformation of the cover. The robot is also provided with a spring-loaded plate with an upward camber fore and aft which is used to press a "paper mop" onto a floor surface. The paper mop absorbs dust and rubbish from the floor surface. A spring-biased catch clip is mounted to the spring-loaded plate and is used to removably attach the paper mop. Because the deformable cover has a substantial ground clearance, the robot does not sense low-lying obstacles such as floor-mounted heating, ventilation and air conditioning (HVAC) ducts, electric cords, and transitions to carpet. When raised by such a low-lying obstacle, the spring-loaded plate tends to lift the drive wheels, causing the robot to stall. In addition, because the robot departs from a circular shape, i.e., the cover is depicted as oval in a plan view, it is more likely to become trapped when rotation is not possible due to closely spaced obstacles such as adjacent chair and table legs. The wheeled robot further poses an underfoot hazard by virtue of having freely rotating wheels that would cause the robot to act like a roller skate, i.e., "skate-out", if stepped upon. Though the left and right drive wheels are connected to motors through a belt drive system, little resistance is offered to this skating action. Also, no allowance is made for alternative cleaning parts beyond changing the paper mop.

In a separate line of development, self-propelled toys capable of some degree of autonomous operation have long been known. An early example is reflected in U.S. Pat. No. 367,420, issued Aug. 2, 1887 to Luchs, which describes a clockwork toy carriage that having obstacle sensing bumpers on each end that mechanically reverse the toy's direction of travel upon collision. More recently, U.S. Pat. No. 2,770,074, issued Nov. 13, 1956 to Jones et al., hereinafter referred to as the Jones et al. patent, discloses a compact, self-propelled toy which circumvents obstructions by rotating and moving away from obstacles upon contact by mechanical feelers. Rotation is accomplished by the use of laterally positioned, independent drive wheels, which, when driven in opposite directions, cause the circular toy to rotate around its vertical axis before proceeding thereby allowing the toy to rotate away from obstacles after collision rather than simply reverse its direction. Unfortunately the feelers, which protrude from the circular shell, are prone to catch on obstacles. Moreover, there is no teaching in the Jones et al. patent that the toy might be equipped with active or passive cleaning parts.

Programmable toy robot kits are also well known in the art. These kits such as the Lego Mindstorms Robotic Invention System require assembly and programming. They are directed to the educational value of building robots and require a knowledge of programming. In the same vein, the text, *Mobile Robots,* $2^{nd}$ Edition (Joseph L. Jones et al., published by A. K. Peters, Natick, Mass., 1999) teaches how to build a "Rug Warrior" robot having a circular shape in order to be able to rotate while in contact with an obstacle, and provided with contact switches that are depressed by the robot's cover when the cover is deformed during a collision with an obstacle. *Mobile Robots* teaches how a robot may be programmed to circumvent obstacles by programming backing and rotation when the cover collides with an obstacle. The Rug Warrior kit, which has been described in a variety of forms from at least 1994, requires substantial technical expertise to assemble and is not sold equipped with active or passive cleaning parts.

As sold the Rug Warrior kit is equipped with a thin, deformable cover attached to the chassis with three short, flexible tubes. The cover clearance is not adjustable and is typically more than 0.33 (⅓) inch above a hard surface floor. As a consequence, the Rug Warrior does not sense low obstacles and frequently rides up over HVAC ducts, carpet transitions, and electric cords becoming hung up as low parts of the rigid chassis contact the obstacles, making unattended use problematic. As in the Ichiro patents, *Mobile Robots* teaches mounting separate contact switches to lower portions of the rigid chassis adjacent the cover. The reliability of the switches depends on the amount of deformation of the cover and the location of the deformation of the cover relative to the switches. For example, if deflection of the cover occurs between two of the switches, the deflection may not be enough to activate the switches. Further, the flexible tubes do no precisely locate the cover relative to the chassis. This problem is aggravated when the cover or flexible tubes become distorted, e.g., through exposure to excessive heat. Accordingly, the cover may remain pressed against at least one of the contact switches giving a false, continuing indication of a collision. Increasing the number of switches, and increasing the spring constant of each switch to better release the switch contacts, would reduce the reliability problem but at greater expense and complexity. Also as in the Ichiro et al. applications, the wheeled Rug Warrior poses an underfoot hazard by virtue of having freely rotating wheels that would cause the robot to skate out if stepped upon. Though the left and right drive wheels are connected to motors through a drive system, little resistance is offered to this skating action. Further, the thin, deformable cover may fracture to create sharp edges that present the possibility of injury.

SUMMARY OF THE INVENTION

An object of the invention is to provide an enhanced autonomous mobile surface treating apparatus.

Another object of the invention is to provide an autonomous mobile surface treating apparatus that can alternatively provide a plurality of different surface treatment modules.

Another object of the invention is to provide an autonomous mobile surface treating apparatus that avoids being hung up on low obstacles.

Yet another object of the invention is to provide an autonomous mobile surface treating apparatus having an improved collision detection sensor that is more reliable and can be inexpensively produced.

Still another object of the invention is to provide an autonomous mobile surface treating apparatus that can be inexpensively produced, preferably using toy manufacturing processes and materials.

Yet still another object of the invention is to provide an autonomous mobile surface treating apparatus that reduces the risk of "skate-out" if stepped upon.

One aspect of the invention is directed to an autonomous mobile surface treating apparatus that comprises a chassis, a drive mechanism mounted to the chassis by a suspension, and a substantially rigid shell movably mounted to the chassis. The suspension includes a resilient member interposed between the drive mechanism and the chassis so that when the shell is pushed toward the supporting surface with a predetermined force the resilient member compresses to permit the drive mechanism to move and the shell and/or the chassis to contact the supporting surface. This arrangement reduces the risk of the autonomous mobile surface treating apparatus "skating-out" if the stepped upon.

A second aspect of the invention is directed to an autonomous mobile surface treating apparatus that comprises a chassis having a plurality of elongated openings and a substantially rigid shell movably attached to the chassis by a plurality of elongated elastic supports received in the plurality of elongated openings. This arrangement provides substantially free horizontal, but vertically constrained, movement of the shell relative to the chassis. Preferably, this arrangement is used in conjunction with a collision detection sensor having a passive portion attached to a central portion of the rigid shell and an active portion attached to the chassis. This collision detection sensor used in conjunction with a rigid cylindrical shell is more reliable and can be inexpensively produced.

A third aspect of the invention is directed to an autonomous mobile surface treating apparatus that comprises a chassis, a substantially rigid shell movably attached to the chassis, and a non-skid lower edge member movably attached to the shell to adjust a clearance between the non-skid lower edge member and the supporting surface. Preferably the clearance is less than 0.33 inches. This reduces the likelihood that the autonomous mobile surface treating apparatus will become hung up on low obstacles.

A fourth aspect of the invention is directed to an autonomous mobile surface treating apparatus that comprises a chassis having a vacant volume that defines a surface treatment module receiving area adapted to removeably receive a surface treatment module. Preferably, the surface treatment module receiving area is adapted to receive a plurality of types of surface treatment modules. More preferably, a pressure adjusting mechanism is used whereby a surface treating pad applies an adjustable pressure to the supporting surface based on frictional characteristics of the supporting surface.

A fifth aspect of the invention is directed to a surface treatment module adapted to be removably received in a surface treatment module receiving area of an autonomous mobile surface treating apparatus. The surface treatment module comprises a vertical member having a first end and a second end, a surface treating pad attached to the second end of the vertical member, and an attachment mechanism adapted to removeably attach sheet-type surface treating means to the surface treating pad.

BRIEF DESCRIPTION OF THE DRAWINGS

The invention together with the above and other objects and advantages may best be understood from the following detailed description of the preferred embodiments of the invention illustrated in the drawings. In the drawings, like reference numeral depict like elements.

DESCRIPTION OF THE PREFERRED EMBODIMENTS

The autonomous mobile surface treating apparatus of the invention may be used for a variety of surface treatments—not just cleaning. In addition to cleaning, such surface treatments include, for example, treatments that provide "protective" benefits to floors and other surfaces, such as stain and soil protection, fire protection, UV protection, wear resistance, dust mite and insect control, anti-microbial treatment, and the like. Other examples of such surface treatments include, for example, treatments that provide "aesthetic" benefits to floors and other surfaces, such as buffing, odorization/deodorization; and applying polishes.

Figure 1A:
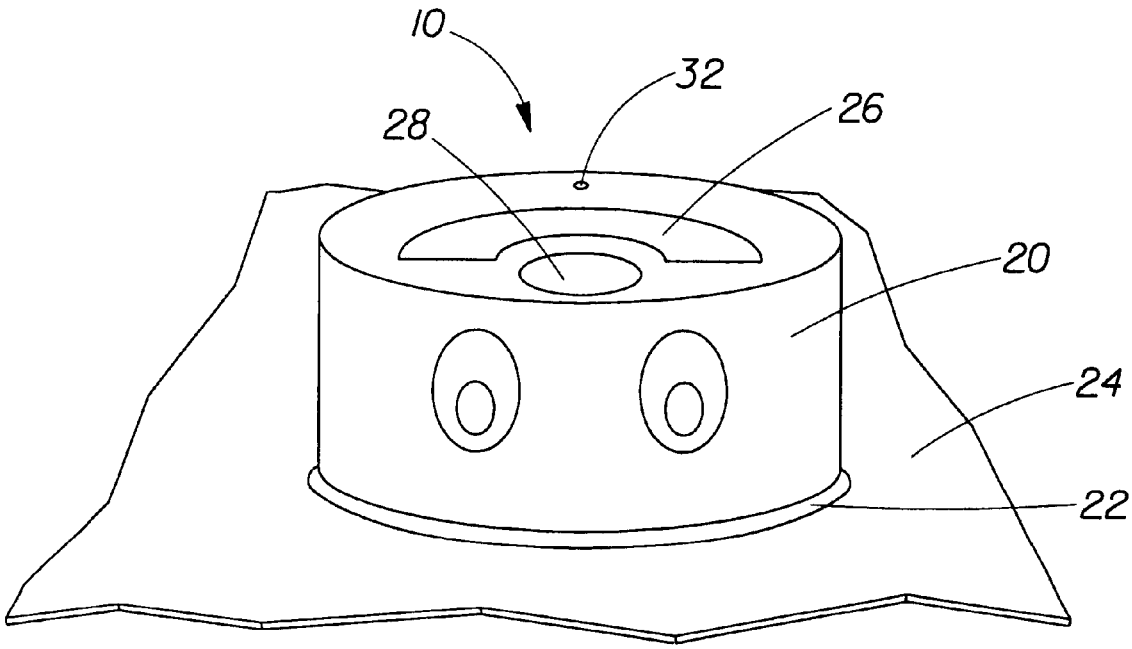
FIG. 1A is a perspective view of an autonomous mobile surface treating apparatus according to an embodiment of the invention.
Figure 1B:
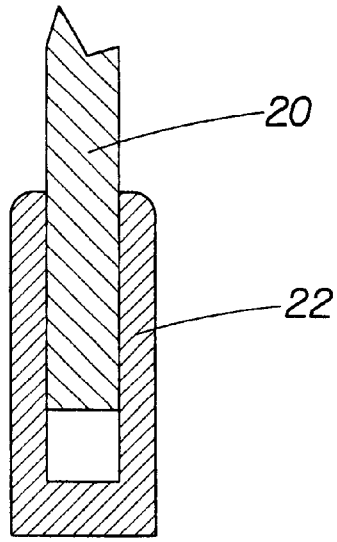
FIG. 1B is a cross section schematic diagram in an elevation view of a lower shell portion of the autonomous mobile surface treating apparatus shown in FIG. 1.

Referring to FIG. 1, an autonomous mobile surface treating apparatus 10 according to an embodiment of the invention includes a substantially cylindrical case or shell 20. The shell 20 is not limited to being cylindrical, but may be any shape. Preferably, however, shell 20 has a substantially circular perimeter, such as a cylinder or dome, so as to reduce the likelihood of autonomous mobile surface treating apparatus 10 becoming trapped due to an inability to rotate.

Preferably shell 20 is substantially rigid and thus unlike the covers of the robots disclosed in the Ichiro applications and the "Rug Warrior" robot in *Mobile Robots,* each of which is designed to easily deform for the purpose of contact switch activation. As described in detail below, the invention preferably uses an improved collision detection sensor that, unlike the prior art, does not depend on cover deformation for switch activation.

Also preferably shell 20 is provided with a non-skid lower edge member 22 made of a high friction material such as rubber. Non-skid lower edge member 22 may be integrally formed with the lower edge shell 20, affixed to the lower edge of shell 20 with fasteners, adhesives and the like, or fitted over the lower edge of shell 20 with an interference fit. Accordingly, when shell 20 is depressed toward a floor or other surface 24 upon which autonomous mobile surface treating apparatus 10 is operating, e.g., stepped upon, the static friction created between non-skid lower edge member 22 and the floor or other surface 24, in combination wheel retraction caused by the improved suspension mechanism discussed in detail below, retards horizontal movement of autonomous mobile surface treating apparatus 10, i.e., skating out, and the floor of other surface 24 is not damaged. It is preferred that non-skid lower edge member 22 extends horizontally so as to serve as a bumper to prevent damage to obstacles such as furniture legs and walls with which autonomous mobile surface treating apparatus 10 collides. The non-skid lower edge member 22 may also serve as a sensor device. That is, non-skid lower edge member 22 may include a sensing means such as conductive foam or piezoelectric material that is compressed by collisions and respectively resists or generates an electrical current that can be used as control input. Through the use of such sensing means, shell 20 need not be movably attached to the chassis of autonomous mobile surface treating apparatus 10 but may instead be rigidly attached thereto.

It is also preferred that non-skid lower edge member 22 be adjustably affixed to or fitted over the lower edge of shell 20 to provide a clearance adjustment between non-skid lower edge member 22 and the floor or other surface 24. An example of such an arrangement is shown in FIG. 1A, which is a cross section schematic diagram in an elevation view of the lower edge of shell 20 and non-skid lower edge member 22. In the example shown in FIG. 1A, non-skid lower edge member 22 is fitted over the lower edge of shell 20 with an interference fit that allows vertical movement of non-skid lower edge 22 relative to the lower edge of shell 20 and thereby adjustment of the clearance between non-skid lower edge member 22 and the floor or other surface 24.

Referring back to FIG. 1, the clearance between the lower edge of shell 20, inclusive of the non-skid lower edge 22, and the floor or other surface 24 upon which autonomous mobile surface treating apparatus 10 operates is preferably substantially uniform about the circumference of shell 20 and more preferably less than 0.33 (⅓) inches. As will be described in greater detail below, when shell 20 contacts an obstacle in the immediate path of autonomous mobile surface treating apparatus 10, shell 20 deflects relative to the chassis of autonomous mobile surface treating apparatus 10, serving to actuate a collision detection sensor. If the ground clearance is substantially greater than 0.33 (⅓) inches, low obstacles such as floor-mounted mounted heating, ventilation and air conditioning (HVAC) ducts, transitions to carpet, or electrical cords will not contact shell 20 and autonomous mobile surface treating apparatus 10 will not sense the obstacle thereby risking becoming stuck or entangled.

The shell 20 preferably has an overall height less than 3.5 (3½) inches if autonomous mobile surface treating apparatus 10 is expected to operate in rooms such as bathrooms and kitchens having counters that overhang the floor. The uppermost portion of shell 20 is preferably higher than any extension of the chassis. A handle 26 is preferably provided on a top surface of autonomous mobile surface treating apparatus 10. The handle 26 may be, for example, moved between a raised, carrying position and a lowered, stowed away position located in a depression on the top of shell 20. In this example, handle 26 may be pivotably or slideably mounted to the chassis of autonomous mobile surface treating apparatus 10 so that handle 26 does not protrude above the top surface of shell 20 when in the lowered, stowed away position, thereby reducing the likelihood of collisions with overhanging counters. Alternatively, a handle may be removeably mounted to the chassis of the autonomous mobile surface treating apparatus 10 by fasteners such as screws so that the handle protrudes above the top surface of shell 20. In this alternative example, the handle may be removed during operation of autonomous mobile surface treating apparatus 10, thereby reducing the likelihood of collisions with overhanging counters. In another alternative, the handle may be rigidly mounted to the chassis in a non-removeable fashion, but with a depression below the handle to allow for gripping. Preferably, the rigidly mounted handle does not protrude above the upper perimeter of shell 20. In other words, it is preferable that the rigidly mounted handle not be able to contact raised horizontal obstacles, such as a chair rung.

Preferably, autonomous mobile surface treating apparatus 10 is provided with a stop button 28 located at an easily accessible position such as the top surface of shell 20. The stop button 28 is operatively connected to a control module discussed in detail below so that operation of autonomous mobile surface treating apparatus 10 may be stopped when stop button 28 is depressed. The stop button 28 may be, for example, mounted to the chassis of autonomous mobile surface treating apparatus 10 and protrude through a hole in the top surface of shell 20. In this example, the hole in the top surface of shell 20 is oversized relative to stop button 28 to allow horizontal motion of shell 20 relative to the chassis of autonomous mobile surface treating apparatus 10. Alternatively, stop button 28 may be a membrane, either mounted to the top surface of shell 20 or integrally formed with the top surface of shell 20, that cooperates with a contact switch mounted to the chassis of autonomous mobile surface treating apparatus 10. This alternative example is advantageous in that the membrane may seal the switch from contaminants such as dust and moisture. In another alternative example, stop button 28 may be directly mounted on shell 20. This additional alternative example is less preferable in that wiring must be routed to stop button 28 between shell 20 and the chassis of autonomous mobile surface treating apparatus 10.

The autonomous mobile surface treating apparatus 10 may optionally have at least one light emitting diode (hereinafter, "LED") 32 and loudspeaker operatively connected to the control module as discussed in detail below. The LED 32 and loudspeaker may, for example, be mounted to the chassis of autonomous mobile surface treating apparatus 10, with LED 32 observable either through a hole in shell 20 or through a transparent or translucent portion of shell 20. Alternatively, LED 32 may be directly mounted on shell 20. This alternative is less preferable in that wiring must be routed to LED 32 between shell 20 and the chassis of autonomous mobile surface treating apparatus 10. The LED 32 and loudspeaker under control of the control of the control module may, for example, respectively react by flashing and producing sounds to various stimuli such as bumping into an obstacles, being picked up, or operating in proximity to a person.

Figure 2:
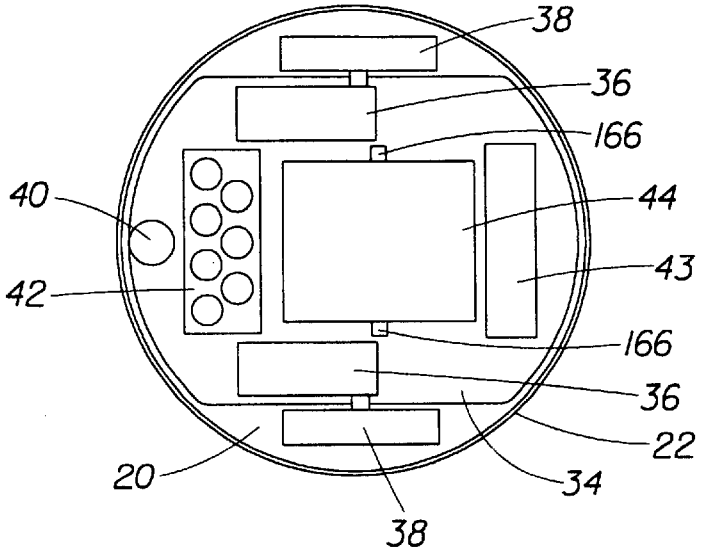
FIG. 2 is a bottom plan view of the autonomous mobile surface treating apparatus shown in FIG. 1.

Referring now to FIG. 2, which is a bottom plan view of autonomous mobile surface treating apparatus 10, shell 20 is mounted on a chassis 34 for deflection when autonomous mobile surface treating apparatus 10 contacts an obstacle as discussed in detail below. A pair of motor-gearboxes 36 is mounted on chassis 34, with each motor-gearbox 36 driving a wheel 38. The autonomous mobile surface treating apparatus 10 is propelled by the two laterally positioned wheels 38 that are independently driven so that one can be reversed relative to the other so that autonomous mobile surface treating apparatus 10 can rotate about its vertical axis. The motor-gearboxes 36 may utilize any conventional gear arrangement for coupling the driving force of a motor to wheel 38. For example, each motor-gearbox 36 may include a DC motor having a spindle attached to a worm gear, which meshes with a spur gear, which through a reduction gear set drives wheel 38. Alternatively, wheels 38 may be directly driven by a motor or indirectly driven by a motor through a belt and pulley arrangement.

A third support is also mounted on chassis 34. The third support may, for example, be a ball-in-socket 40, a static spherical protrusion having a low-friction surface, a caster or the like. Alternatively, a powered ball-in-socket or third powered, steerable wheel may be provided and the laterally positioned wheels may be unpowered. In yet another alternative, the drive mechanism may be a car-like arrangement of four wheels, i.e., a first set of two powered wheels and a second set of two steerable wheels that may or may not be powered. While various drive mechanisms for propelling autonomous mobile surface treating apparatus 10 have been described, the scope of the invention it not limited thereto. Other drive mechanisms that allow a robot to turn, such as track drive mechanisms, are within the scope of the invention. For example, independently driven tracks may be substituted for wheels 38, thereby dispensing with the need for a ball-in-socket 40 and providing superior traction on some surfaces, but at the cost of energy efficiency.

The chassis 34 also includes a battery case 42 that is preferably positioned to balance autonomous mobile surface treating apparatus 10 on its three contact points, i.e., wheels 38 and ball-in-socket 40. More preferably, battery case 42 is positioned diametrically opposite a control module 43 mounted in or on chassis 34, thereby minimizing the impact of electromagnet interference (EMI) upon control module 43, i.e., the EMI originates from the batteries within battery case 42. In addition, chassis 34 preferably includes a vacant volume that defines a surface treatment module receiving area 44 for receiving a surface treatment module as discussed in detail below. More preferably, surface treatment module receiving area 44 is positioned between battery case 42 and control module 43. Preferably, several types of surface treatment modules may be installed within surface treatment module receiving area 44. Once a particular type of surface treatment module is selected, the surface treatment module is preferably installed by placing autonomous mobile surface treating apparatus 10 over the surface treatment module and pressing autonomous mobile surface treating apparatus 10 down until the surface treatment module snaps into place.

Preferably, low lying elements of chassis 34 such as the motor-gearboxes 36 are positioned substantially above the non-skid lower edge 22 of shell 20 so that autonomous mobile surface treating apparatus 10 does not become trapped on obstacles which shell 20 passes over but which would then contact such low lying elements. In other words, no part of chassis 34 should be lower than non-skid lower edge 22 of shell 20, except wheels 38 and ball-in-socket 40. Likewise, an installed surface treatment module may be positioned lower than the non-skid lower edge 22 of shell 20.

Shell 20 is preferably without any protrusions so that the robot can freely rotate while in contact with an obstacle. However, it may alternatively be desirable to attach one or more flexible brushes to autonomous mobile surface treating apparatus 10 that protrude beyond the radius of shell 20.

Figure 3:
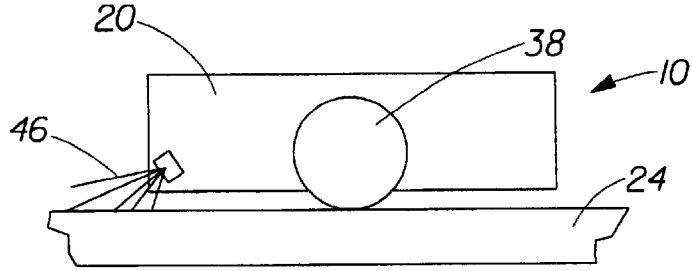
FIGS. 3 and 4 are schematic diagrams, respectively in a side view and a bottom plan view, of a first modified version of the autonomous mobile surface treating apparatus shown in FIGS. 1 and 2 that includes a pair of flexible brushes.
Figure 4:
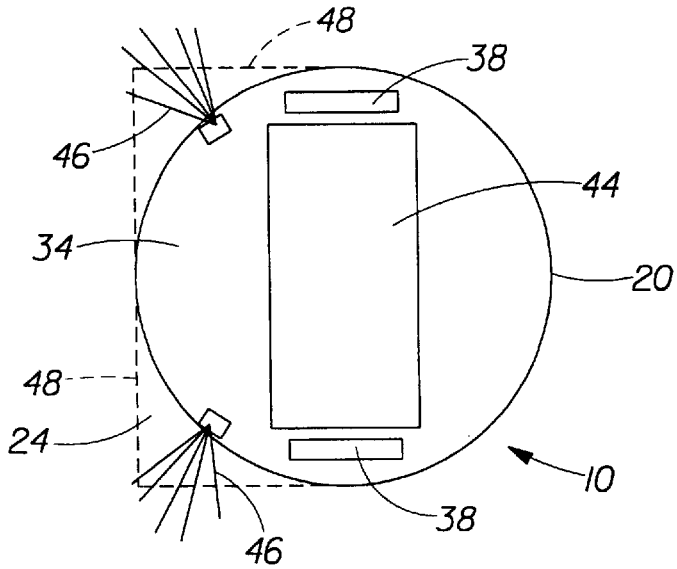
Figure 5:
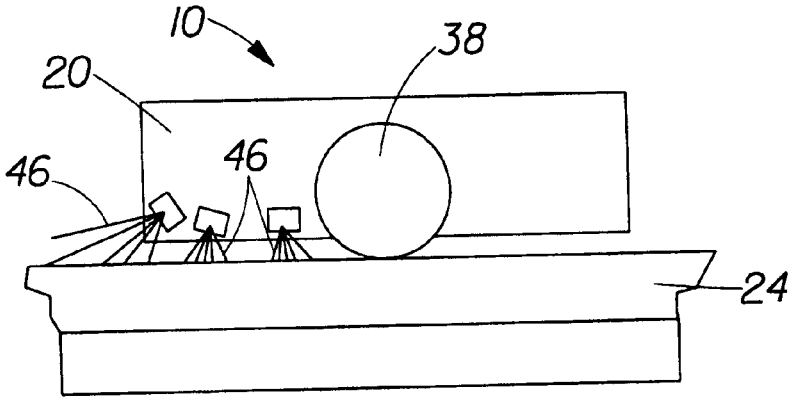
FIGS. 5 and 6A are schematic diagrams, respectively in a side view and a bottom plan view, of a second modified version of the autonomous mobile surface treating apparatus shown in FIGS. 1 and 2 that includes several flexible brushes.
Figure 6A:
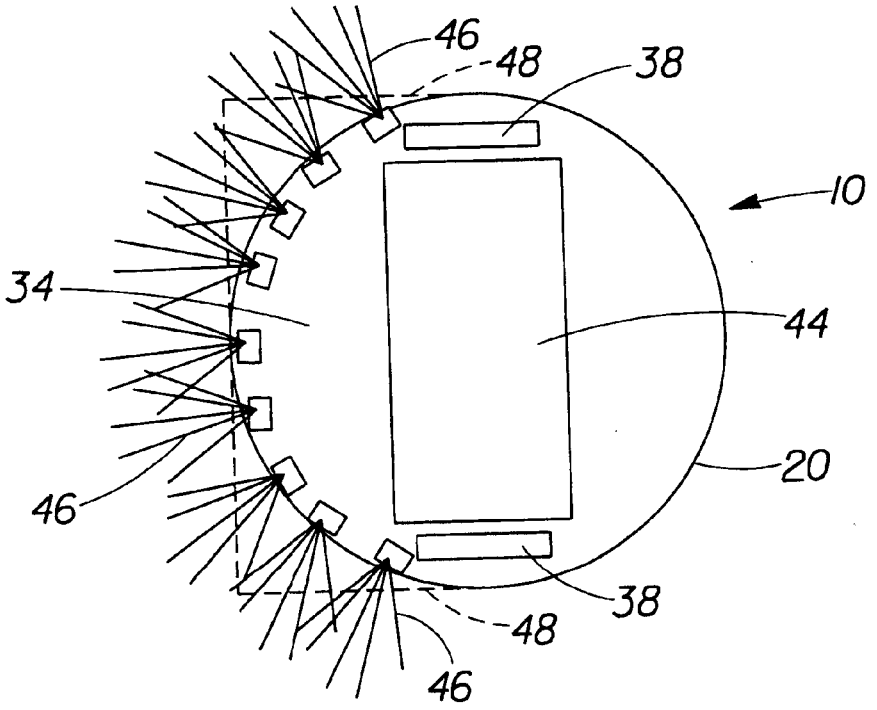
Figure 6B:
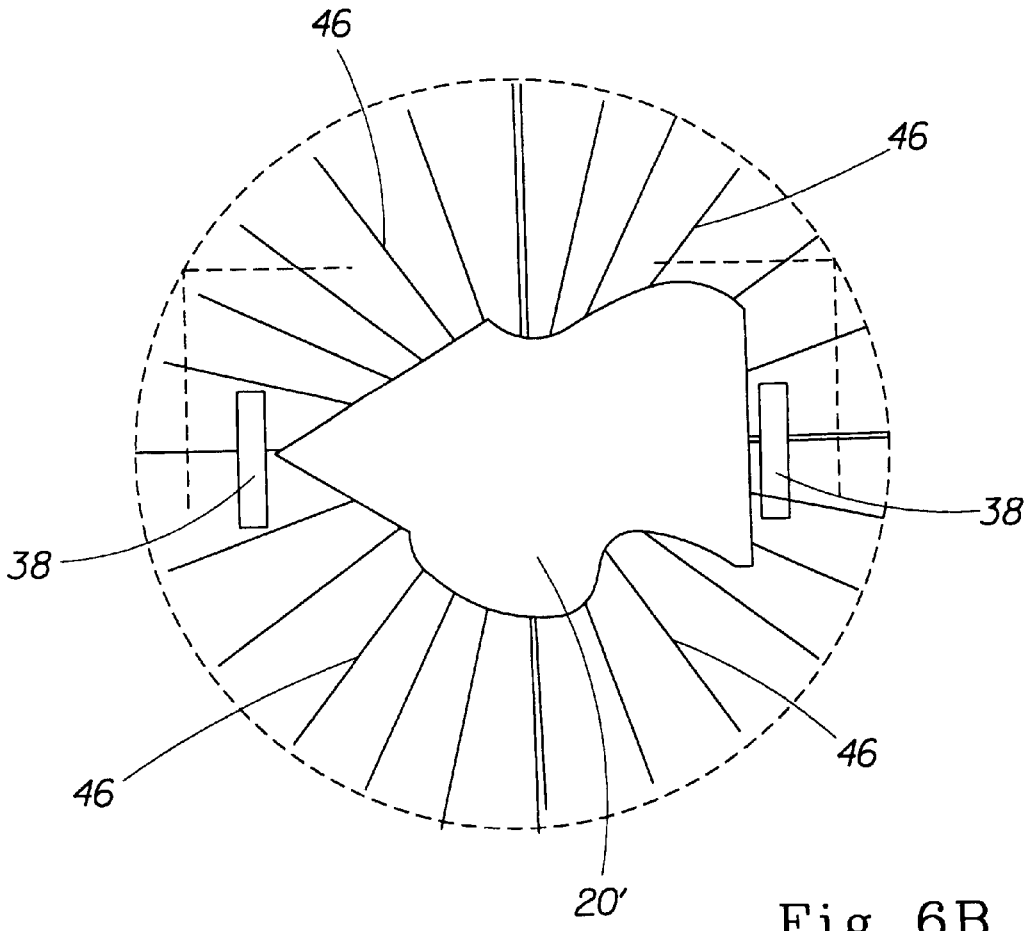
FIG. 6B is a schematic diagram of a top plan view of a third modified version of the autonomous mobile surface treating apparatus shown in FIGS. 1 and 2 that includes several flexible brushes that present an overall peripheral shape different from the shape of the shell.

FIGS. 3–6 and 6A show modified versions of autonomous mobile surface treating apparatus 10 that include flexible brushes 46. Flexible brushes 46 may, for example, reach corners of the floor or other surface 24 all the way to the walls 48 so as to sweep dust and debris into the path of the surface treating module. The flexible brushes 46 may extend from locations partially or completely around the periphery of shell 20. The flexible brushes 46 also serve to act as extensions of the shell 20 so as to cause "soft" collisions between shell 20 and the obstacles. In other words, the flexible brushes 46 act not only as a cleaning mechanism, but also as flexible downward and outward extensions of shell 20 to sense low-lying obstacles. As shown in FIG. 6A, if the shell departs from a cylindrical form, such as shell 20', flexible brushes 46 of varying length may be used so that the outer ends of flexible brushes 46 taken together substantially describe a circle as projected onto the floor or other surface 24 in plan view. The flexible brushes 46 may be attached to autonomous mobile surface treating apparatus 10 using conventional adhesives or fasteners. Preferably, flexible brushes 46 are attached to shell 20 or chassis 34. Alternatively, flexible brushes 46 may be incorporated into non-skid lower edge member 22. Preferably, flexible brushes 46 are disposable and thus removeably attached using, for example, hook and loop fasteners. As shown in FIGS. 3 and 4, one of the flexible brushes 46 may be attached to extend to each side of autonomous mobile surface treating apparatus 10 for registration with corners on opposite sides of autonomous mobile surface treating apparatus 10. As shown in FIGS. 5 and 6, several additional flexible brushes 46 may be attached to autonomous mobile surface treating apparatus 10 to provide a more thorough sweeping of the corners.

Figure 7A:
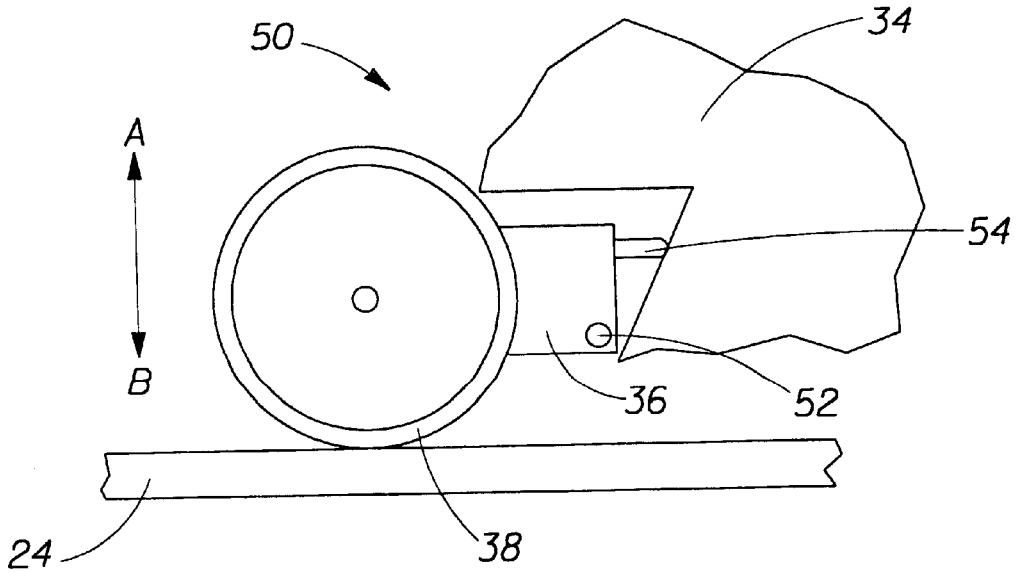
FIG. 7A is a schematic diagram in an elevation view of a preferred wheel suspension system of the autonomous mobile surface treating apparatus shown in FIGS. 1 and 2.
Figure 7B:
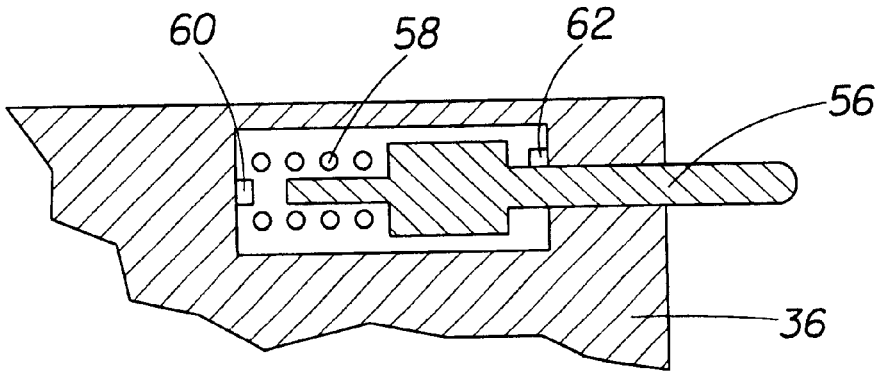
FIG. 7B is a cross section schematic diagram in an elevation view of a portion of the preferred wheel suspension system shown in FIG. 7.

Referring now to FIG. 7, a preferred wheel suspension system 50 of autonomous mobile surface treating apparatus 10 is shown in an elevation view with the shell 20 removed. Although a preferred wheel suspension system is shown, modifications thereof as well as other types of wheel suspension mechanisms may be used instead. Wheel suspension system 50 is shown for the purpose of illustration, and the invention is not limited thereto. Wheel suspension system 50 is used for both wheels 38. Each wheel 38 is driven by motor-gearbox 36 that is pivotably mounted to chassis 34 using a pivot pin 52. Upward rotation of motor-gearbox 36 in direction A, e.g., when autonomous mobile surface treating apparatus 10 is pushed down toward the floor or other surface 24, is resisted by a resilient element 54 interposed between motor-gearbox 36 and chassis 34.

Referring now to FIG. 7A, which is a cross section schematic diagram in an elevation view of a portion of motor-gearbox 36, the resilient element 54 may be, for example, a pin 56 mounted in or on motor-gearbox 36 that contacts chassis 34 and is biased by a spring 58. Alternatively, resilient element 54 may be a spring biased pin mounted in or on chassis 34 to contact the motor-gearbox 36. In another alternative, resilient element 54 may be a rubber peg attached to either motor-gearbox 36 or chassis 34 to contact the other. The resilient element 54 may be attached to chassis 34 with threads or a sliding friction fit so that the length of its extension from chassis 34 to motor-gearbox 36 is adjustable. Alternatively, such a resilient element with an adjustable length-of-extension may be attached to motor-gearbox 36. In either case, it can be seen that such an adjustment will serve to adjust the riding height above the floor of chassis 34 by causing motor-gearbox 36 to rotate upward or downward about pivot pin 56. Alternatively, resilient elements of varying lengths may be substituted for one another for the same purpose.

Referring back to FIG. 7, resilient element 54 preferably allows wheels 38 to rise into chassis 34 if autonomous mobile surface treating apparatus 10 is pushed down, e.g., stepped upon, toward the floor or other surface 24 so that one or more of the non-skid lower edge member 22, shell 20, a lower part of chassis 34 and a surface treatment module contacts the floor or other surface 24. This arrangement minimizes the risk of autonomous mobile surface treating apparatus 10 wheeling out from underfoot like a roller skate, i.e., skating out, when it is stepped upon. This arrangement also provides autonomous mobile surface treating apparatus 10 with improved traction on uneven surfaces.

The pivotable arrangement of motor-gearboxes 36 relative to chassis 34 preferably allows motor-gearboxes 36 and hence wheels 38 to fall toward the floor or other surface 24, i.e., motor-gearboxes 36 rotate in direction B, when autonomous mobile surface treating apparatus 10 loses contact with the floor or other surface 24.

Preferably, autonomous mobile surface treating apparatus 10 is provided with suspension sensors that are actuated when autonomous mobile surface treating apparatus 10 is pushed down, lifted up, or one or both wheel lose contact with the floor or other surface 24. Referring back to FIG. 7A, a contact sensor 60, for example, may be positioned within each of the motor-gearboxes 36 to sense if pin 56 has reached a predetermined compressed position, i.e., the position that is occupied by pin 56 when autonomous mobile surface treating apparatus 10 is pushed down with a predetermined amount of force. Accordingly, autonomous mobile surface treating apparatus 10 can thereby sense when it is being pushed down and control module 43 makes an appropriate response, such as turning off the motors within motor-gearboxes 62. Moreover, an additional contact sensor may be provided to sense another predetermined compressed position occupied as a result of a lesser compression of pin 56 caused by increased motor torque and moment reacting upon one or both motor-gearboxes 62 as a consequence of a horizontal collision, as opposed to the much greater compression resulting from being stepped upon. The control module 43 may, for example, respond by reversing motors and then subsequently one or the other motors within the motor-gearboxes 62, causing autonomous mobile surface treating device 10 to briefly back and then rotate before attempting to proceed forward, thus circumventing the obstacle with which it collided. Similarly, another contact sensor 62 may be positioned within each of the motor-gearboxes 62 to sense if pin 56 has reached a predetermined extended position, i.e., the position that is occupied by pin 56 when autonomous mobile surface treating apparatus 10 is lifted or at least one of the wheels 38 loses contact with the floor or other surface 24. The autonomous mobile surface treating apparatus 10 can thereby sense when it is being picked up or has lost traction, and control module 43 can make an appropriate response, such as turning off or reversing the motors within motor-gearboxes 62. Of course, other responses may be desirable depending on the situation. For example, if autonomous mobile surface treating apparatus 10 is being used to spray a surface treating solution, or toxic or irritating substance, the suspension sensors may be used to prevent a curious child from being sprayed by the substance upon lifting autonomous mobile surface treating apparatus 10.

Figure 8:
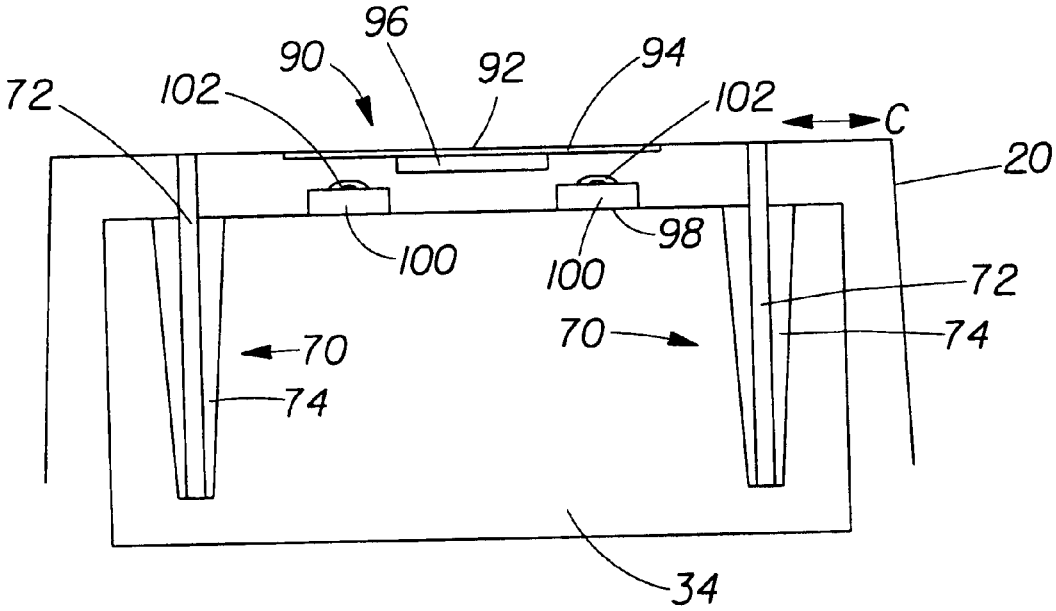
FIG. 8 is a cross section schematic diagram in an elevation view of a preferred collision detection sensor and a preferred attachment mechanism of the autonomous mobile surface treating apparatus shown in FIGS. 1 and 2.
Figure 9:
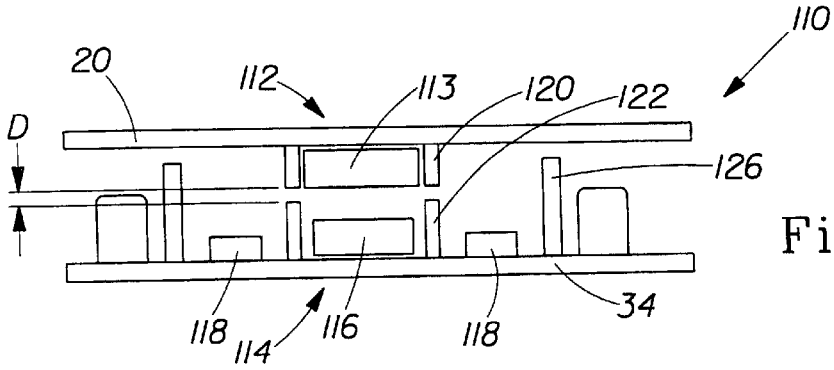
FIG. 9 is a cross section schematic diagram in an elevation view of an alternative collision detection sensor in a non-displaced position.
Figure 10:
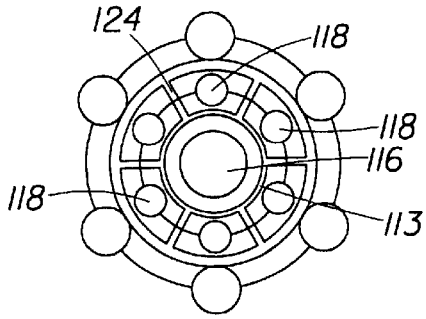
FIG. 10 is a schematic diagram in a top plan view of the alternative collision detection sensor shown in FIG. 9.

FIG. 8 shows a preferred attachment mechanism 70 for movably attaching shell 20 to chassis 34, as well as a preferred collision detection sensor 90 for sensing horizontal motion of shell 20 relative to chassis 34. Preferably, collision detection sensor 90 also senses compression of shell 20 toward chassis 34 such as when autonomous mobile surface treating apparatus 10 is stepped upon. Although a preferred attachment mechanism and a preferred collision detection sensor are shown, modifications thereof as well as other types of attachment mechanisms and collision detection sensors may be used instead. Attachment mechanism 70 and collision detection sensor 90 are shown for the purpose of illustration, and the invention is not limited thereto.

The shell 20 is movably attached to chassis 34 by two or more elastic supports 72 which may be, for example, springs, elastic rods, elastic tubes or the like, each received within a cone-shaped opening 74 in chassis 34. Preferably, elastic supports 72 are sufficiently compressible to collapse under vertical load. The bottom of each elastic support 72 is attached to chassis 34 and the top of each elastic support 72 is attached to shell 20. When shell 20 is brought into contact with an obstacle while moving horizontally, e.g., in the direction of arrow C, shell 20 is free to move in a nearly horizontal arc relative to chassis 34. The cone-shaped openings 74 allow elastic supports 72 to be relatively long even though the overall height of autonomous mobile surface treating apparatus 10 is preferably short to avoid counters that may overhang the floor. Preferably, the length of elastic supports 72 is at least ½ the height of autonomous mobile surface treating apparatus 10, and more preferably at least ¾ that height. The relatively long length of elastic supports 72 provides a substantially free, but vertically constrained, movement of shell 20 relative to chassis 34. This arrangement allows a strong, rigid case or shell 20 (that can be stepped upon without shattering) to be used rather than the thin, deformable covers of prior art autonomous mobile cleaning devices.

The vertical clearance between the underside of shell 20 and the top of chassis 34 is preferably at least as great as the ground clearance between the non-skid lower edge member 22 and the floor or other surface 24, which as previously described with respect to FIG. 1 is preferably less than 0.33 (⅓) inches.

Referring again to FIG. 8, collision detection sensor 90 senses horizontal motion of shell relative to chassis 34. The collision detection sensor 90 includes a passive portion 92 attached to the underside of shell 20. The term "passive" is used in the sense that no electrical conductors need to be routed to passive portion 92 for it to operate. Locating passive portion 92 of collision detection sensor 90 on shell 20 is advantageous in that no electrical conductors need be routed from chassis 34 to shell 20. The passive portion 92 includes a large conductive disk 94 sandwiched between shell 20 and a small conductive disk 96. The large conductive disk 94 and small conductive disk 96 are attached to shell 20 so as to be concentric relative to one another and shell 20.

The collision detection sensor 90 also includes an active portion 98 attached to chassis 34. The term "active" is used in the sense that electrical conductors need to be routed to active portion 98 for it to operate. The active portion 98 of collision detection sensor 90 includes one or more, preferably three or more, electrical contact sensors 100 (only two are shown in FIG. 8) arranged at equal angular intervals in a circle that is concentric with small conductive disk 96 and large conductive disk 94 when shell 20 is in its non-displaced position relative to chassis 34. Each electrical contact sensor 100 includes two electrical contacts 102 (only one is shown in FIG. 8) separated by a gap. When shell 20 contacts an obstacle, shell 20 is displaced relative to chassis 34 in vector 180 degrees away from the contact point. The small conductive disk 96, which is displaced along with shell 20, travels over at least one of the electrical contact sensors 100. If displaced a sufficient amount, small conductive disk 96 activates at least one of the electrical contact sensors 100 by bridging the gap between electrical contacts 102. Each of the electrical contact sensors 100 is operatively connected to control module 43. The direction of the displacement of shell 20 is determined by control module 43 based on which one (or ones) of the three or more electrical contact sensors 100 has (have) been activated. By determining the direction of the displacement, control module 43 may, for example, rotate, or back and rotate, autonomous mobile surface treating apparatus 10 away from the obstacle before proceeding forward again. Accordingly, autonomous mobile surface treating apparatus 10 can reliably circumnavigate obstacles in its environment.

Collision detection sensor 90 preferably also senses compression of shell 20 toward chassis 34 such as when autonomous mobile surface treating apparatus 10 is stepped upon. When shell 20 is forced vertically downward, large conductive disk 94 electrically bridges the gap between electrical contacts 102 in all of the electrical contact sensors 100. Once control module 43 determines that this condition is present, control module 43 may, for example, shut off the motors within motor-gearboxes 36.

Alternatively, an optical sensor may be used for collision detection. Referring now to FIGS. 9–12, which show an optical collision detection sensor 110, a passive portion 112 is attached to shell 20 and an active portion 114 is attached to chassis 34. The passive portion 112 of optical collision detection sensor 110 includes a reflective disk 113, which is attached to shell 20 so as to be concentric relative to shell 20. The active portion 114 of optical collision detection sensor 110 includes an illumination source 116, such as an LED, and six optical receiving sensors 118, such as photo diodes, arranged at equal angular intervals in a circle that is concentric with reflective disk 113 when shell 20 is in its non-displaced position relative to chassis 34, i.e., the position shown in FIGS. 9 and 10. Of course, more than one illumination source 116 may alternatively be used. Likewise, more or less than six optical receiving sensors 118 may alternatively be used. For example, one or more source/sensor pairs may be used, i.e., each pair consisting of one illumination source and one optical receiving sensor. The illumination source 116 and optical receiving sensors 118 are mounted facing upward toward reflective disk 113.

Figure 11:
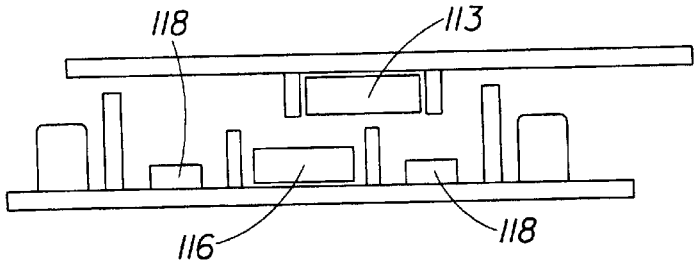
FIG. 11 is a cross section schematic diagram in an elevation view of the alternative collision detection sensor shown in FIG. 9 but in a displaced position.
Figure 12:
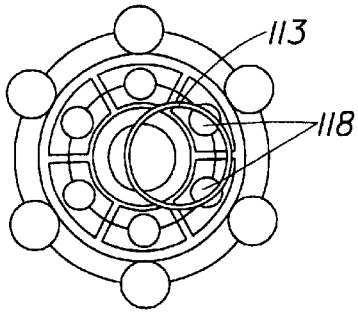
FIG. 12 is a schematic diagram in a top plan view of the alternative detection sensor shown if FIG. 9 but in the displaced position.

Preferably, reflective disk 113 is mounted within a light barrier ring 120 and illumination source 116 is mounted within a light barrier ring 122, with light barrier rings 120 and 122 spaced apart a distance D to reduce light leakage. Similarly, radial light barriers 124 are preferably located between adjacent optical receiving sensors 118 to reduce light leakage. A light barrier ring 126 preferably surrounds the optical receiving sensors 118 to reduce the introduction of stray light. When shell 20 is displaced horizontally relative the chassis 34, reflective disk 113 is brought over one or more optical receiving sensors 118 as shown in FIGS. 11 and 12. Thus, when an obstacle displaces shell 20, light is transferred from illumination source 116 to activate one or more optical receiving sensors 118 via reflective disk 113. Each of the optical receiving sensors 118 is operatively connected to control module 43. The direction of the displacement of shell 20 is determined by control module 43 based on which one (or ones) of the optical receiving sensors 118 has (have) been activated. By determining the direction of the displacement, control module 43 may, for example, rotate, or back and rotate, autonomous mobile surface treating apparatus 10 away from the obstacle before proceeding forward again. Accordingly, autonomous mobile surface treating apparatus 10 can reliably circumnavigate obstacles in its environment.

It will be recognized by those skilled in the art, that many other types of collision detection sensors may alternatively be used to sense movement of shell 20 relative to chassis 34. For example, multiple discrete contact switches such as those disclosed in the Ichiro applications may be used. Alternatively, Hall effect sensors may be used, i.e., a magnet may be mounted on a central portion of shell 20 to cooperate with multiple Hall effect sensors mounted on chassis 34. Also, sensors that use pattern recognition to identify the direction of displacement may be used. With such sensors, different patterns are located in different areas, such as in different sectors of a passive disk, which may be mounted to the shell, for example. Accordingly, the direction of displacement is determined based on which of the different patterns is detected by an active sensor, such as an optical, magnetic or capacitive transducer, which may be mounted to the chassis, for example, so as to be able to read the different patterns on the passive disk when the shell is displaced.

Figure 13:
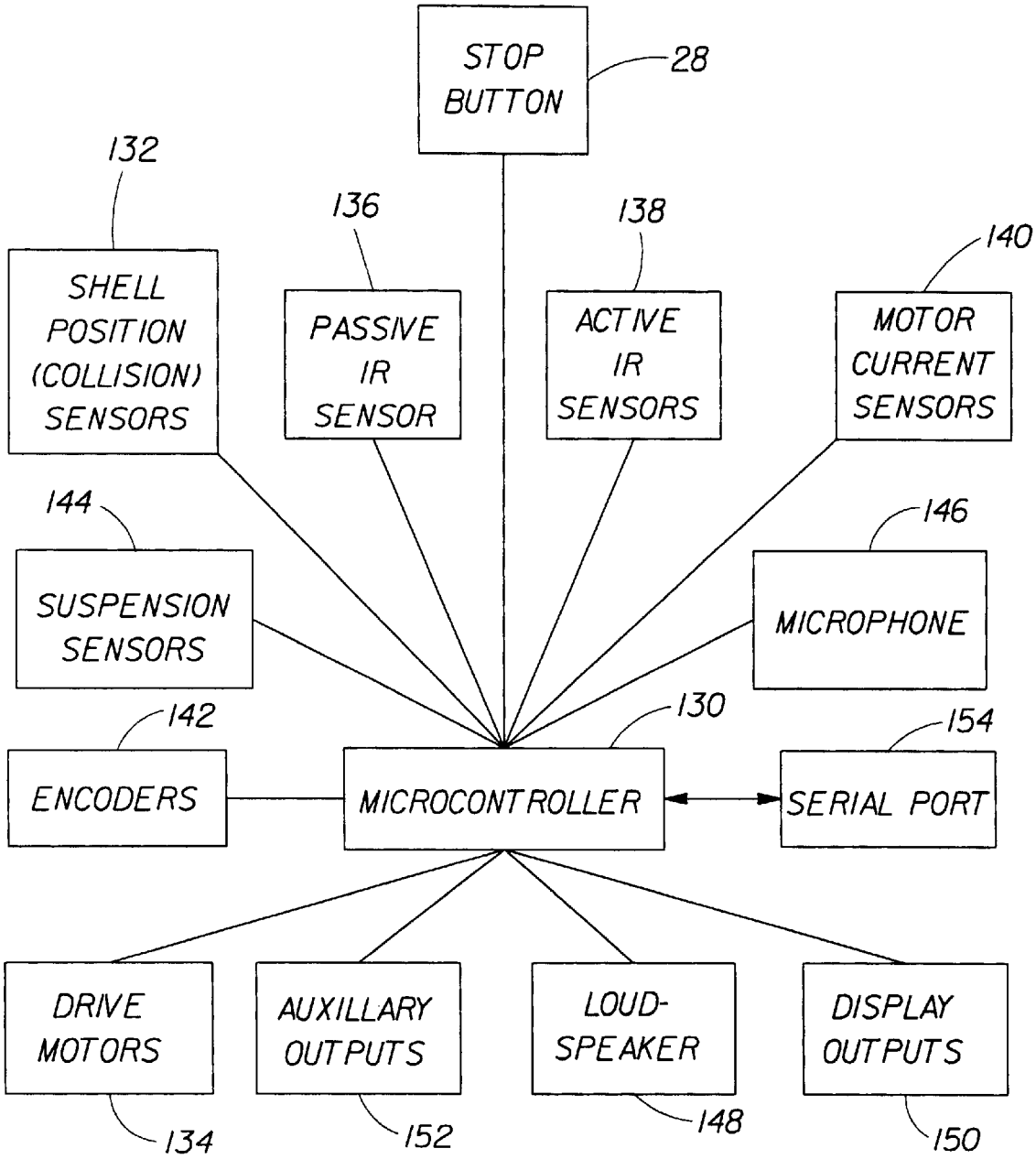
FIG. 13 is a schematic block diagram of electronic components of the autonomous mobile surface treating apparatus shown in FIGS. 1 and 2.

FIG. 13 is a schematic block diagram of electronic components of autonomous mobile surface treating apparatus 10. The control module 43 includes a microcontroller 130 that receives digital signals directly from various sensors or indirectly through an analog to digital converter (hereinafter, "ADC"). The microcontroller 130 includes a digital data processor that executes a sequence of machine-readable instructions. The microcontroller 130 also preferably includes a memory in which the machine-readable instructions reside. The machine-readable instructions are used to control autonomous mobile surface treating apparatus 10 and may comprise any one of a number of programming languages known in the art (e.g., C, C++). For example, the machine-readable instructions may control the movement of autonomous mobile surface treating apparatus 10 so as to utilize any of the various movement operations known in the art, such as a random walk mode of operation or a patterned walk mode of operation. Of course, the machine-readable instructions preferably control other functions of autonomous mobile surface treating apparatus 10 as well. Accordingly, microcontroller 130 is operatively connected to receive input from at least one collision detection sensor 132, e.g., collision detection sensor 90 or optical collision detection sensor 110, and to provide output to at least one drive motor 134, e.g., the motors within motor-gearboxes 36.

The microcontroller 130 may also be operatively connected to receive input from at least one passive IR sensor 136, which may, for example, detect the presence of an animal or a human. The term "passive" is used in the sense that the IR sensor detects the presence of an object but does not measure the distance to the object. The passive IR sensor 136 may, for example, be mounted on shell 20. The microcontroller 130 may, for example, cause an audio or visual alert to be issued in response the detection of the presence of an animal or human.

Another input to microcontroller 130 may be provided by at least one active IR sensor 138. The term "active" is used in the sense that the IR sensor 138 has the ability to measure the distance to a detected object. The active IR sensor 138 preferably employs uniquely modulated IR emissions so as to minimize interference from other IR sources in the operating environment. The active sensor 138 may, for example, be used to detect an obstacle before autonomous mobile surface treating apparatus 10 contacts it. For example, microprocessor 130 may slow autonomous mobile surface treating apparatus 10 to minimize impact in response to the detection of an obstacle, or turn autonomous mobile surface treating apparatus 10 away from the obstacle avoiding contact all together. A single active IR sensor 138 may be used to good effect on the front of autonomous mobile surface treating apparatus 10 by frequently rotating autonomous mobile surface treating apparatus 10 to each side of its forward path to detect obstacles near sides of its path, or by similarly rotating active IR sensor 138 relative to the chassis. Alternatively, multiple active IR sensors 138 may be used. As will be apparent to those skilled in the art, other non-contact active sensor types, such as sensors employing ultrasonic, acoustic, microwave, or laser energy, may be used in lieu of active IR sensor 138. It will also be apparent to those skilled in the art that sensors of these types may be used with relatively inexpensive acoustic, optical, or microwave lenses that broaden or narrow the effective path that is sensed.

The microcontroller 130 may also be operatively connected to receive input from at least one motor current sensor 140. Preferably, the motors within motor gearboxes 36 are each equipped with a current sensor 140 so that conditions of wheel slip and/or over-torque can be detected. The microcontroller 130 may respond to these detected conditions by, for example, turning off the motors. Alternatively, microcontroller 130 may respond to these conditions by adjusting the pressure applied to a surface treating pad of a pressure adjusting surface treatment module, as discussed in detail below. For example, microcontroller 130 may respond to an over-torque condition by reducing the pressure on the surface treating pad and respond to an under-torque condition by increasing the pressure on the surface treating pad. Motor current sensing may also be used to detect collisions. Thus, motor current sensing may be used as an inexpensive primary means of obstacle collision detection or a backup means of obstacle collision detection for collisions not registered by shell 20. An analog to digital converter (ADC) converts an analog signal from motor current sensor 140 into a digital signal that is provided to microcontroller 130.

Likewise, microcontroller 130 may also be operatively connected to receive input from at least one encoder 142 that measures wheel revolutions. For example, each of the motor-gearboxes 36 may be equipped with an encoder 142 to detect abnormal wheel speed. Again, the microcontroller 130 may respond to this detected condition by, for example, turning off the motors. Alternatively, microcontroller 130 may respond to this condition by adjusting the pressure applied to a surface treating pad of a pressure adjusting surface treatment module, as discussed in detail below. For example, microcontroller 130 may respond to an abnormally slow speed condition by reducing the pressure on the surface treating pad and respond to an abnormally fast speed condition by increasing the pressure on the surface treating pad.

Another input to microcontroller 130 may be provided by at least one suspension sensor 144 to detect, for example, when autonomous mobile surface treating apparatus 10 is pushed down, lifted up, or one or both wheels lose contact with the floor or other surface 24. The suspension sensor 144 may, for example, correspond to contact sensors 60 and 62 shown in FIG. 7A. When one of these conditions is detected, microcontroller 130 makes an appropriate response, such as turning off the motors. Of course, other responses may be desirable depending on the situation. For example, if autonomous mobile surface treating apparatus 10 is being used to spray a cleaning solution, microcontroller 130 may respond by turning off the spraying mechanism.

The condition of autonomous mobile surface treating apparatus 10 being pushed down may also be detected by collision detection sensor 90, i.e., when large conductive disk 94 electrically bridges the gap between electrical contacts 102 in all of the electrical contact sensors 100, as discussed above with regard to FIG. 8. Accordingly, microcontroller 130 may use the input from all of the electrical contact sensors 100 of collision detection sensor 90 to detect when autonomous mobile surface treating apparatus 10 is pushed down. Again, when this condition is detected, microcontroller 130 makes an appropriate response, such as turning off the motors.

The stop button 28 shown in FIG. 2 also is operatively connected to microcontroller 130. When depression of stop button 28 is detected, the microcontroller 130 makes an appropriate response, such as turning off the motors.

Referring again to FIG. 13, microcontroller 130 may also be operatively connected through an ADC to receive input from at least one microphone 146. The microphone 146 may, for example, be mounted on shell 20. The microcontroller 130 may, for example, cause an audio or visual alert to be issued in response the detection of the presence of an animal or human.

In addition, microcontroller 130 may be operatively connected to a network adapter 154, which may include a serial port, to connect microcontroller 130 to other computers to download and upload data and software. For example, network adapter 154 may be used to interface microcontroller 130 to the Internet by digital and analog links and wireless.

The microcontroller 130 may also be operatively connected to at least one auxiliary control output 152, which may, for example, control electrical functions in the surface treatment modules or in other portions of the of autonomous mobile surface treating apparatus 10. For example, microcontroller 130 may control a spraying function in a surface treatment module of autonomous mobile surface treating apparatus 10. In another example, microcontroller 130 may control the amount of pressure applied to a surface treating pad of a pressure adjusting surface treatment module, as discussed in detail below.

Preferably, microcontroller 130 is operatively connected through an audio driver to at least one audio output 148, such as a loudspeaker, and through a display driver to at least one display output 150, such a liquid crystal diode (hereinafter "LCD") screen or an LED. Accordingly, microcontroller 130 may issue audio and visual alerts using audio output 148 and display output 150.

Figure 14:
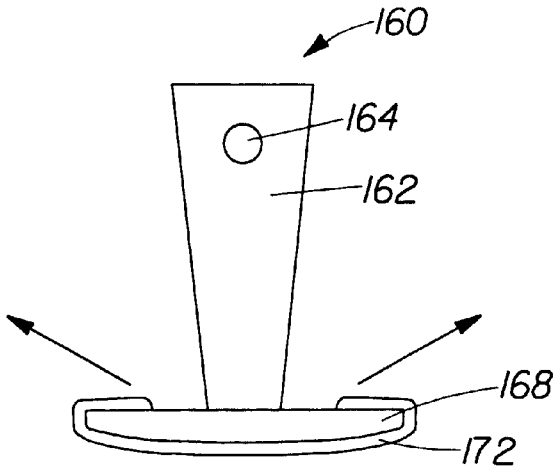
FIG. 14 is a schematic diagram in an elevation view of a surface treatment module for the autonomous mobile surface treating apparatus shown in FIGS. 1 and 2.
Figure 15:
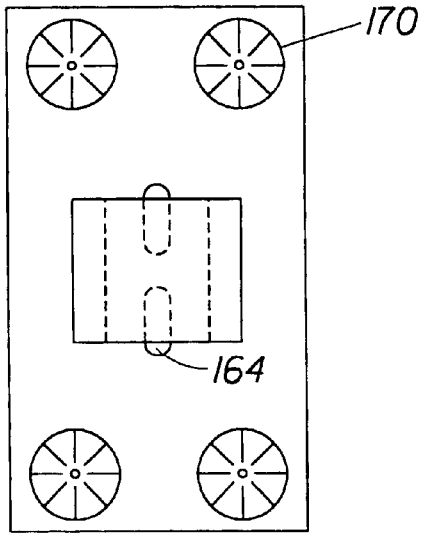
FIG. 15 is a schematic diagram in a top plan view of the surface treatment module shown in FIG. 14.

FIGS. 14 and 15 illustrate a surface treatment module 160 that is accepted into surface treatment module receiving area 44 of chassis 34. It is to be understood that this is only one example of a plurality of modules that may be provided for autonomous mobile surface treating apparatus 10. For example, such a module may be dedicated to a function other than surface treating, such as playing music. The surface treatment module 160 is preferably installed by lowering autonomous mobile surface treating apparatus 10 over a vertical member 162 of surface treatment module 160 at least until a pair of elastic protrusions 164 expands into a pair of substantially vertical slots 166 (shown in FIG. 2) provided in opposing walls of surface treatment module receiving area 44 of chassis 34. Preferably, expanded elastic protrusion 164 is substantially free to travel vertically in vertical slot 166. Consequently, the weight of surface treatment module 160 is supported almost exclusively (less minor friction between elastic protrusions 164 and vertical slots 166) by a surface treating pad or surface contact form 168 resting on the floor or other surface 24. This results in a relatively uniform contact force between surface contact form 168 and the floor or other surface 24 that is not affected by a spring constant. It also allows for a contact force to be provided for that is independent of the weight of the other components of autonomous mobile surface treating apparatus 10. In addition, hollow portions of surface treatment module 160, such as a hollow portion within vertical member 162, may be used as containers for surface treating fluids such as a cleaning fluid, a buffing oil, a suspended wax, an abrasive, or some other fluid which is to be applied to the floor or other surface 24. For example, cleaning fluids or water may be dispensed through a porous portion of the surface treating pad by gravity through a valve or by varying the pressure within the container as described in detail below.

Alternatively, a surface treating function of surface treatment module 160 may be non-removeably integrated into the structure of the chassis 34 by providing a rigid pin instead of the elastic protrusion 164. Likewise, vertical member 162 may be replaced with vertical rods free to slide through a plate within surface treatment module receiving area 44 of chassis 34 above surface contact form 168. In any event, it is preferable that surface contact form 168 not be configured to press upward on chassis 34 through a spring or other elastic means. In other words, the surface contact pressure of surface contact form 168 is preferably to be had from the weight of surface treatment module 160 or weighting materials or liquids applied to it. If the surface contact pressure can be transferred to chassis 34, it is likely at some point to lift chassis 34 reducing traction.

Preferably, vertical member 162 of surface treatment module 160 has a tapered shape. The clearance provided by the tapered shape allows the surface contact form 168 to rock fore and aft. This rocking motion and the curved fore and aft surface of surface contact form 168 provide for more uniform contact of sheet-type surface treating means 172, which is preferably removeably mounted on the surface contact form 168, with the floor or other surface 24.

The upper surface of the surface contact form 168 is preferably provided with attachment points 170 for sheet-type surface treating means 172. The sheet-type surface treating means 172 may be, for example, a dust cloth, waxing cloth, woven or non-woven cloth, wetted sheet (wetted with materials such as oil, water and wax), sponge, foam sheet, mop or the like. In addition, it may be desirable to provide inwardly sweeping brushes disposed so as to sweep inwardly from the outer edges of the surface treatment module. As illustrated, attachment points 170 are pie-shaped sections of relatively stiff, resilient plastic arranged so that sheet-type surface treating means 172 pressed into the center of attachment point 170 will be caught in the points of the pie shaped sections as the sections close together when the downward pressure used to insert sheet-type surface treating means 172 is released. Accordingly, sheet-type surface treating means 172 is attached to surface contact form 168 by simply folding sheet-type surface treating means 172 over the surface contact form 168 and pressing sheet-type surface treating means 172 into attachment points 170. Similar attachment points may be found on the SWIFFER® brand dust mops available from The Procter & Gamble Company, Cincinnati, Ohio. Of course, the invention is not limited to attachment mechanisms of the attachment point type, which is shown for the purpose of illustration. Other types of attachment mechanisms may alternatively be used, such as spring-biased clips, hook and loop fasteners, and adhesives.

The inventors have discovered that particularly good cleaning performance and buffing occurs when a oil-wetted polymer cloth having an entangled fiber or microfiber configuration is applied with adequate downward force, i.e., preferably about 10 ounces or more with a 24 square inch surface, by for autonomous mobile surface treating apparatus 10 operated in a random-walk mode of operation. One example of such a cloth is the SWIFFER® brand dusting cloths, available from The Procter and Gamble Company, Cincinnati, Ohio. The combination of a random walk mode of operation, wherein autonomous mobile surface treating apparatus 10 passes multiple times over the same surface area, along with a substantial downward contact force surprisingly provides for buffing of the surface in addition to the anticipated dusting action. The buffing action is not apparent in manual (typically single-pass) applications of the cloth. Although buffing can be done manually, the process is too time consuming to be practical.

Figure 16:
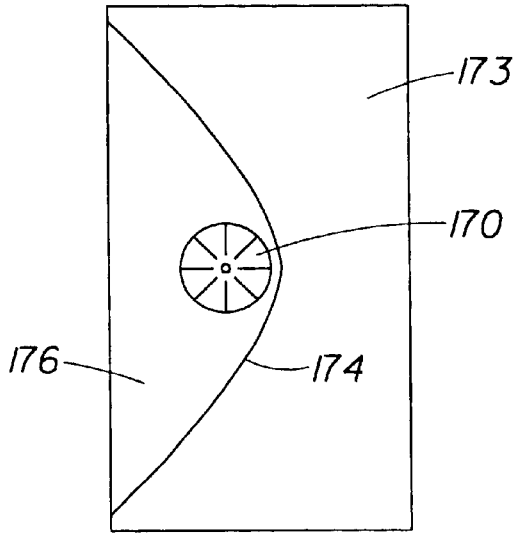
FIG. 16 is a schematic diagram in a bottom plan view of an alternative surface treatment module for the autonomous mobile surface treating apparatus shown in FIGS. 1 and 2.

The sheet-type surface treating means 172 may also serve to disinfect. For example, damp wipes, such as the Mr. CLEAN® brand wipes available from The Procter and Gamble Company, Cincinnati, Ohio, may be provided with a disinfectant agent to disinfect hard surfaces.-IN FIG. 16 shows an alternative surface treatment module having a different configuration on the bottom of a surface contact form 173. This alternative surface contact form 173 has a semicircular raised portion 174 so that when the surface contact form 173 is contacting the floor or other surface 24, a semicircular vacant space 176 is formed between the surface contact form 173 and the floor or other surface 24. The semicircular vacant space 176 prevents particles that have been collected from spilling off the leading edge of the surface contact form 173. It will be recognized that the vacant space may have a form other than semicircular. For example, the vacant space may be an open rectangle or triangle with the open end facing forward or be comprised of a plural grooves with forward facing open ends. Preferably, the overall rectangular shape at the top of the surface contact form 173 is maintained so that common rectangular sheet-type surface treating means 172 may be used. Preferably, the surface of the semicircular vacant space 176 is provided with an attachment point 170 to prevent sheet-type surface treating means 172 from drooping at that point. Alternatively, other attachment mechanisms, such as spring-biased clips, hook and loop fasteners, and adhesives, may be used.

Figure 17:
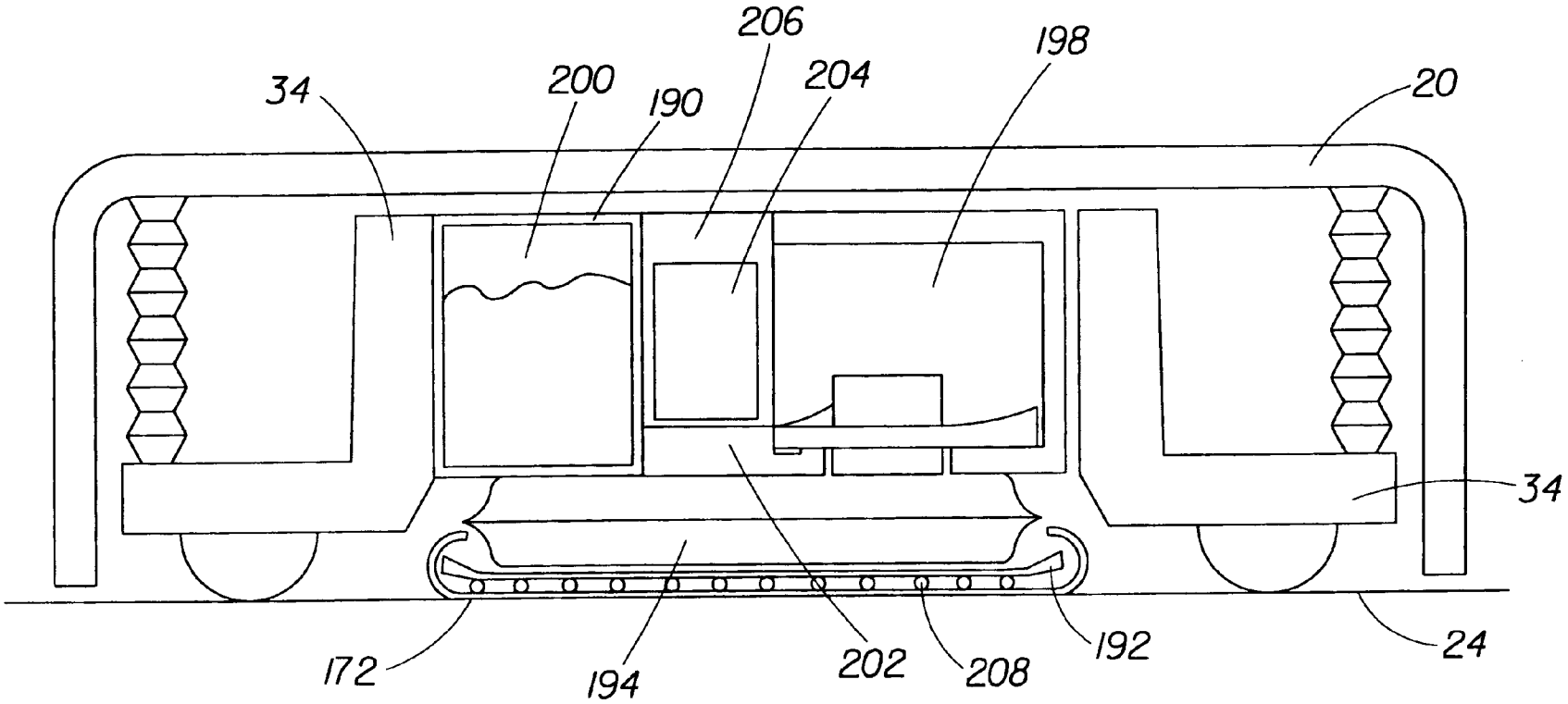
FIG. 17 is a cross section schematic diagram in an elevation view of another alternative surface treatment module.

FIG. 17 is a cross section schematic diagram in an elevation view of another alternative surface treatment module, i.e., a pressure adjusting surface treatment module 190. As discussed above, microcontroller 130 through auxiliary output 152 may respond to conditions such as motor over-torque, wheel slip, and abnormal wheel speed by adjusting the pressure applied to a surface treating pad 192 of pressure adjusting module 190. Accordingly, the pressure applied to surface treating pad 192 may be adjusted to compensate for the frictional characteristics of the floor or other surface 24. For example, microcontroller 130 may respond to an over-torque condition, e.g., caused by a high friction floor or other surface 24, by reducing the pressure on surface treating pad 192 and respond to an under-torque condition, e.g., caused by a low friction floor or other surface 24, by increasing the pressure on surface treating pad 192. A flexible bag 194 is interposed between surface treating pad 192 and an upper body portion 196 of pressure adjusting module 190. The flexible bag contains a fluid, e.g., water, and is in fluid communication with a hydraulic head chamber 198, which is in selective fluid communication with a fluid storage chamber 200 through a channel 202. The passage of fluid through channel 202 is controlled by microcontroller 130 by operation of a motor 204 having an impeller within channel 202. Consequently, microcontroller 130 controls the pressure applied to surface treating pad 192 through adjustment of the height of the fluid in hydraulic head chamber 198 that provides a hydraulic head above surface treating pad 192.

Pressure adjusting module 190 may be configured to fit within, or a snap into, module receiving area 44 of chassis 34. This allows a portion of the weight of pressure adjusting module 190 to be transferred to the wheels, wherein the portion depends on the weight on surface treating pad 192 provided by the hydraulic head. It is to be understood that the fluid storage chamber 200 and its contents is to be substantially supported by the wheels of the autonomous mobile surface treating device 10. Additionally, pressure adjusting module 190 is configured with an electrical connector (not shown) to mate with a corresponding electrical connector (not shown) within module receiving area 44 of chassis 34 so as to electrically connect motor 204 to microcontroller 130 through auxiliary output 152.

It should be further understood that the fluid used in pressure adjusting module 190 may be a surface treating fluid such as a cleaning fluid, a buffing oil, a suspended wax, an abrasive, or some other fluid that is to be applied to the floor or other surface 24. The fluid is preferably applied through holes or pores in the bottom of flexible bag 194 and surface treating pad 192, and then through a porous element, such as a porous version of sheet-type surface treating means 172, to the floor or other surface 24. Preferably, the porous element has good wicking characteristics, i.e., the fluid is drawn through the porous element by capillary action. The porous element may be, for example, sponge, foam sheet, woven or non-woven cloth with entangled fibers, a porous material containing a granular absorbent material. By varying the hydraulic head (pressure) the rate of fluid application can be controlled, as well as the downward pressure exerted on surface treating pad 192 and sheet-type surface treating means 172. The fluid application rate may, for example, be controlled in relationship to drag forces sensed by motor current sensing in accordance with the fluid application task such as increasing the pressure and fluid application rate when a gritty or dirty floor area is encountered, which will typically be occasioned by higher friction between the floor and the pad, increasing drag forces. Alternatively, the fluid may be applied at a controlled rate through pores in flexible bag 194 located in advance of (relative to the forward motion of autonomous mobile surface treatment apparatus 10) rather than through surface treating pad 192 and sheet-type surface treating means 172, with the application rate being controlled in the same manner. In another alternative, the fluid may be applied from fluid storage chamber 200 using another motor that is independent of motor 204. Of course, the fluid may also be applied from another fluid storage chamber in pressure adjusting module 190, in another module or in chassis 34. In any event, the fluid application rate is preferably controlled by microcontroller 130 in a similar manner, for example, in relationship to drag forces sensed by motor current sensors 140.

The flexible bag 194 is attached to, or integrally formed with, surface treating pad 192. Preferably, surface treating pad 192 is a flexible plastic or rubber plate having ribs 208. The flexibility of surface treating pad 192 allows it to conform to uneven floors and other surfaces 24. The sheet-type surface treating means 172 is removeably attached to surface treating pad 192 using an attachment mechanism, such as attachment points, spring-biased clips, hook and loop fasteners, and adhesives.

It should be further realized that flexible bag 194 can alternatively be filled with a granular solid to provide for a compliant treatment surface independent of the hydraulic devices of pressure adjusting module 190. This form of complaint treatment surface can also be used in conjunction with the previously described (non-hydraulic) surface treatment module 160. The granular solid may be any material but preferably includes particle forms that will not pack together, e.g., the particles that are essentially smooth and substantially spherical.

Although autonomous mobile surface treating apparatus 10 is preferably provided with detachable surface treatment modules, it should be realized that in some instances it may be advantageous to integrate some or all of the surface treating function into chassis 34. Accordingly, various components of the surface treatment modules discussed herein may be integrated into the chassis, rather than being part of the surface treatment module.

While the invention here has been described with reference to the details of the illustrated embodiments, these details are not intended to limit the scope of the invention as defined in the appended claims.

We claim:

1. An autonomous mobile surface treating apparatus for treating a supporting surface, comprising:

a chassis;

a drive mechanism mounted to said chassis by a suspension;

a substantially rigid shell movably mounted to said chassis;

said suspension including a resilient member interposed between said drive mechanism and said chassis so that when said shell is pushed toward the supporting surface with a predetermined force said resilient member compresses to permit said drive mechanism to move relative to said chassis and at least one of said shell and said chassis to contact the supporting surface.

2. An autonomous mobile surface treating apparatus as recited in claim 1, wherein said suspension includes a sensor that senses when said resilient member has reached a predetermined compressed position.

3. An autonomous mobile surface treating apparatus as recited in claim 1, wherein said suspension is movably mounted to said chassis so that when the autonomous mobile surface treating apparatus is lifted away from the supporting surface said drive mechanism moves toward the supporting surface.

4. An autonomous mobile surface treating apparatus as recited in claim 3, wherein said resilient member expands toward a predetermined extended position when the autonomous mobile surface treating apparatus is lifted away from the supporting surface and wherein said suspension includes a sensor that senses when said resilient member has reached said predetermined extended position.

5. An autonomous mobile surface treating apparatus as recited in claim 1, further comprising a sensor that senses when the autonomous mobile surface treating apparatus is lifted away from the supporting surface.

6. An autonomous mobile surface treating apparatus as recited in claim 1, wherein said shell includes a non-skid lower edge member that contacts the supporting surface when said shell is pushed toward the supportieng surface with a predetermined force.

7. An autonomous mobile surface treating apparatus for treating a supporting surface, comprising:

a chassis having a plurality of elongated openings;

a substantially rigid shell omni directionally movably attached to said chassis by a plurality of elongated supports received in said plurality of elongated openings.

8. An autonomous mobile surface treating apparatus as recited in claim 7, wherein the autonomous mobile surface treating apparatus has an overall height of less than 3.5 inches measured from the supporting surface to a top surface of said shell.

9. An autonomous mobile surface treating apparatus as recited in claim 7, wherein said shell is rotationally movably attached to said chassis, whereby said shell can move rotationally relative to said chassis.

10. An autonomous mobile surface treating apparatus as recited in claim 7, further comprising a non-skid lower edge member attached to said shell adjacent to the supporting surface, wherein said non-skid lower edge member extends beyond the periphery of said shell.

11. An autonomous mobile surface treating apparatus as recited in claim 10, wherein a clearance between said non-skid lower edge member and the supporting surface is less than 0.33 inches.

12. An autonomous mobile surface treating apparatus as recited in claim 7, wherein said shell is substantially cylindrical and has a substantially circular top, further comprising a collision detection sensor having a passive portion attached to said top of said shell and an active portion attached to said chassis.

13. An autonomous mobile surface treating apparatus as recited in claim 12, wherein said passive portion of said collision detection sensor includes a conductive disk and said active portion of said collision detection sensor includes at least three electrical contact sensors.

14. An autonomous mobile surface treating apparatus as recited in claim 12, wherein said passive portion of said collision detection sensor includes a reflective disk and said active portion of said collision detection sensor includes at least three optical receiving sensors.

15. An autonomous mobile surface treating apparatus as recited in claim 7, wherein said shell is substantially cylindrical and further comprising a plurality of brushes attached to at least one of said shell and said chassis and extending beyond the radius of said shell.

16. An autonomous mobile surface treating apparatus for treating a supporting surface, comprising:

a chassis;

a substantially rigid shell movably attached to said chassis;

a non-skid lower edge member movably attached to said shell to adjust a clearance between said non-skid lower edge member and the supporting surface.

17. An autonomous mobile surface treating apparatus as recited in claim 16, wherein said clearance is less than 0.33 inches.

18. An autonomous mobile surface treating apparatus for treating a supporting surface, comprising:

a chassis having a vacant volume that defines a surface treatment module receiving area adapted to removably receive any one of a plurality of types of surface treatment modules wherein said surface treatment module receiving area includes a slot that is adapted to permit the surface treatment module to move substantially freely in the direction of said slot; and a drive mechanism attached to said chassis.

19. An autonomous mobile surface treating apparatus for treating a supporting surface, comprising:

a surface treatment module having a surface treating pad;

a chassis having a volume that defines a surface treatment module receiving area in which said surface treatment module is removeably received; and a drive mechanism attached to the chassis;

wherein said surface treatment module is provided with an attachment mechanism adapted to removeably attach sheet-type surface treating means to said surface treating pad, said sheet-type surface treating means is an oil-wetted polymer cloth.

20. An autonomous mobile surface treating apparatus as recited in claim 19, wherein said attachment mechanism includes a plurality of attachment points having pie-shaped sections for receiving the sheet-type surface treating means.

21. An autonomous mobile surface treating apparatus as recited in claim 19, wherein said surface treatment module includes a pair of elastic protrusions each slideably received in a slot provided in a wall of said surface treatment module receiving area.

22. An autonomous mobile surface treating apparatus for treating a supporting surface, comprising:

a surface treatment module having a surface treating pad;

a chassis having a volume that defines a surface treatment module receiving area in which said surface treatment module is removeably received; and a drive mechanism attached to the chassis;

wherein said surface treatment module includes a pressure adjusting mechanism whereby said surface treating pad applies an adjustable pressure to the supporting surface.

23. An autonomous mobile surface treating apparatus as recited in claim 22, wherein the pressure applied to the supporting surface by said surface treating pad is adjusted based on a frictional characteristic of the supporting surface.

24. An autonomous mobile surface treating apparatus as recited in claim 22, wherein the pressure applied to the supporting surface by said surface treating pad is adjusted by changing the height of a hydraulic head.

25. A surface treatment module adapted to be removably received in a surface treatment module receiving area of an autonomous mobile surface treating apparatus, comprising:

a vertical member having a first end and a second end; and a surface treating pad attached to said second end of said vertical member;

wherein said surface treatment module is provided with an attachment mechanism adapted to removeably attach sheet-type surface treating means to said surface treating pad, said sheet-type surface treating means is an oil-wetted polymer cloth.

26. A surface treatment module as recited in claim 25, wherein said vertical member includes a pair of elastic protrusions at said first end each adapted to be slideably received in a slot provided in a wall of the surface treatment module receiving area of the autonomous mobile surface treating apparatus.

27. A surface treatment module as recited in claim 25, wherein said attachment mechanism includes a plurality of attachment points having pie-shaped sections for receiving the sheet-type surface treating means.

28. An autonomous mobile surface treating apparatus for treating a supporting surface, comprising:

a chassis;

a drive mechanism mounted to said chassis by a suspension;

said suspension allowing said chassis to contact the supporting surface when the autonomous mobile surface treating apparatus is subjected to a force toward the supporting surface greater than the weight of the autonomous mobile surface treating apparatus.

29. An autonomous mobile surface treating apparatus as recited in claim 28, further comprising at least one sensor to sense said force or movement of said suspension.

30. An autonomous mobile surface treating apparatus for treating a supporting surface, comprising:

a chassis;

a drive mechanism mounted to said chassis;

a fluid container mounted to said chassis and adapted to contain a fluid;

a porous element removably mounted to said chassis and disposed so as to contact said supporting surface;

a flow control device interposed between said fluid container and said porous element; and a microcontroller operatively connected to said flow control device to control delivery of the fluid from said fluid container to said porous element.

31. An autonomous mobile surface treating apparatus as recited in claim 30, wherein said microcontroller controls the flow rate to the fluid based on a characteristic of the supporting surface.

32. An autonomous mobile surface treating apparatus as recited in claim 30, wherein said porous element is a porous sheet-type surface treating means.

* * * * *